US006726447B2

(12) United States Patent
Lutz

(10) Patent No.: US 6,726,447 B2
(45) Date of Patent: Apr. 27, 2004

(54) VARIABLE GEOMETRY TURBINE

(75) Inventor: Ernst Lutz, Wolfhalden (CH)

(73) Assignee: Iveco Motorenforschung AG, Schlossgasse (CH)

( * ) Notice: Subject to any disclaimer, the term of this patent is extended or adjusted under 35 U.S.C. 154(b) by 0 days.

(21) Appl. No.: 10/153,504

(22) Filed: May 24, 2002

(65) Prior Publication Data

US 2003/0026692 A1 Feb. 6, 2003

(30) Foreign Application Priority Data

May 25, 2001 (IT) ..... TO2001A0506

(51) Int. Cl.[7] ..... F01D 17/16
(52) U.S. Cl. ..... 415/158
(58) Field of Search ..... 415/157, 158, 415/159, 165, 191, 193, 208.1, 208.2, 208.3

(56) References Cited

U.S. PATENT DOCUMENTS 4,802,817 A 2/1989 Tyler ..... 415/157
5,443,362 A 8/1995 Crites et al. ..... 415/184

FOREIGN PATENT DOCUMENTS

EP 0 034 915 A1 9/1981 ..... F04D/29/46
EP 0 654 587 A 5/1995 ..... F01D/17/14
EP 0 678 657 A2 10/1995 ..... F01D/17/14
GB 305 214 10/1929

OTHER PUBLICATIONS

European Search Report re: 02011298.3–2315 dated Sep. 11, 2002.

European Search Report re: 02011298.3–2315 dated Sep. 11, 2002.

*Primary Examiner*—Edward K. Look
*Assistant Examiner*—Richard A. Edgar
(74) *Attorney, Agent, or Firm*—Finnegan, Henderson, Farabow, Garrett & Dunner, LLP

(57) ABSTRACT

A variable geometry turbine, particularly for a supercharger turbocompressor of an internal combustion engine, comprising an outer housing forming a spiral inlet channel for an operating fluid, a rotor supported in a rotary manner in the housing, and an annular vaned nozzle of variable geometry interposed radially between the channel and the rotor; the nozzle comprises a pair of vaned rings facing one another and provided with respective pluralities of vanes tapered substantially as wedges and adapted to penetrate one another, one of which can move axially with respect to the other in order to define a variable throat section between these vaned rings.

13 Claims, 3 Drawing Sheets

VARIABLE GEOMETRY TURBINE

The present invention relates to a variable geometry turbine. The preferred, but not exclusive, field of application of the invention is in superchargers of internal combustion engines, to which reference will be made in the following description in a non-limiting manner.

BACKGROUND OF THE INVENTION

Turbines are known that comprise a spiral inlet channel surrounding the rotor of the turbine and a vaned annular nozzle interposed radially between the inlet channel and the rotor. Variable geometry turbines (VGT) are also known in which the vaned annular nozzle has a variable configuration so that flow parameters of the operating fluid from the inlet channel to the rotor can be varied. According to a known embodiment, the variable geometry nozzle comprises an annular control member moving axially to vary the throat section, i.e. the working flow section, of this nozzle. This annular control member may be formed, for instance, by a vane support ring from which the vanes extend axially and which can move axially between an open position in which the vanes are immersed in the flow and the throat section of the nozzle is maximum, and a closed position in which the ring partially or completely closes the throat section of the nozzle. During the forward movement of the ring, the vanes of the nozzle penetrate through appropriate slots in a housing provided in the turbine housing in a position facing this ring.

Variable geometry nozzles of the type described briefly above have a number of drawbacks.

First, the vanes necessarily have to have a "straight" profile, i.e. constant in the axial direction, without any torsion or variation of pitch angle. If not, the axial movement of the vanes in the respective slots would be possible only by providing substantial play between the vanes and the slots, which would be detrimental to the efficiency of the nozzle.

In addition to the design limits discussed above, nozzles with straight vanes sliding in respective slots are subject to problems of seizing; in practice even small geometrical errors due to manufacturing tolerances or heat distortions during operation may cause the nozzle to seize.

SUMMARY OF THE INVENTION

The object of the present invention is to provide a turbine with a vaned nozzle provided with an axially moving control member which is free from the drawbacks connected with known turbines and described above.

This object is achieved by the present invention which relates to a variable geometry turbine comprising a housing, a rotor supported in a rotary manner in this housing, the housing defining an inlet channel for an operating fluid in the form of a spiral surrounding the rotor, and an annular vaned nozzle of variable geometry interposed radially between the channel and the rotor so as to control the flow of the operating fluid from the channel to the rotor, characterised in that the annular vaned nozzle of variable geometry comprises a first vaned ring and a second vaned ring facing one another, each of the vaned rings comprising an annular member and a plurality of vanes rigidly connected to the annular member and extending towards the annular member of the other vaned ring, the vanes being tapered substantially as wedges so that the two pluralities of vanes may penetrate one another, at least one of the vaned rings being axially mobile with respect to the other vaned ring in order to define a variable throat section between the vaned rings.

BRIEF DESCRIPTION OF THE DRAWINGS

The invention is described below with reference to a number of preferred embodiments, given by way of non-limiting example, and illustrated in the accompanying drawings, in which.

DETAILED DESCRIPTION OF THE INVENTION

Figure 1:
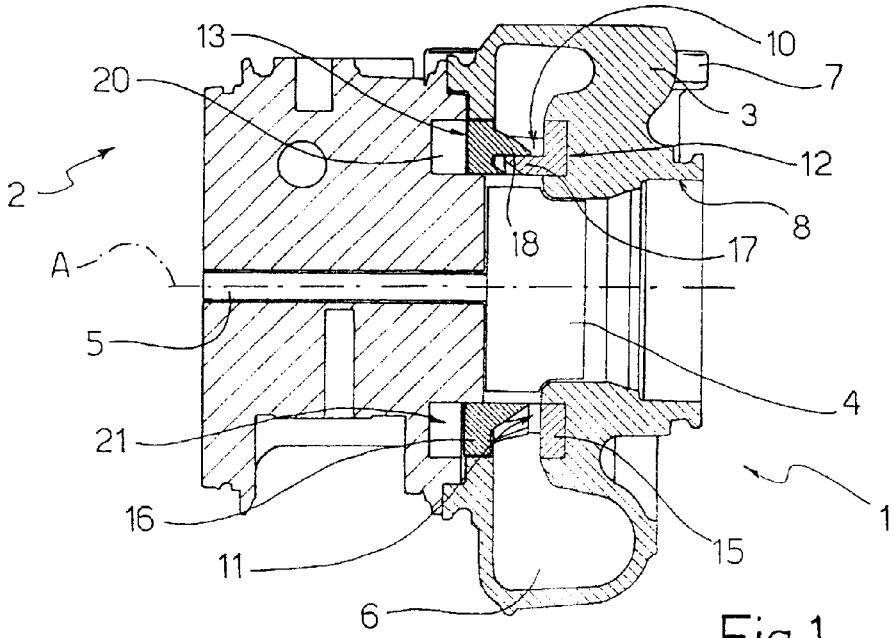
FIG. 1 is an axial section through a variable geometry turbine of the present invention.

In FIG. 1, a variable geometry turbine is shown overall by 1; the turbine is advantageously used in a turbocompressor 2 (shown in part) for supercharging an internal combustion engine.

The turbine 1 essentially comprises a housing 3 and a rotor 4 of axis A supported in a rotary manner about the axis A and rigidly connected with a drive shaft 5 of a compressor (not shown). The housing 3 defines, in a known manner, a spiral inlet channel 6 surrounding the rotor 4 and provided with an inlet opening 7 adapted to be connected to an exhaust manifold (not shown) of the engine. The housing 3 further defines an axial outlet duct 8 for the exhaust gases at the outlet of the rotor 4.

The turbine 1 lastly comprises a vaned annular nozzle 10 of variable geometry which is interposed radially between the inlet channel 6 and the rotor 4 and defines a throat section 11, i.e. a working section of minimum flow of the nozzle 10, which can be varied to control the flow of exhaust gases from the inlet channel 6 to the rotor 4.

Figure 2:
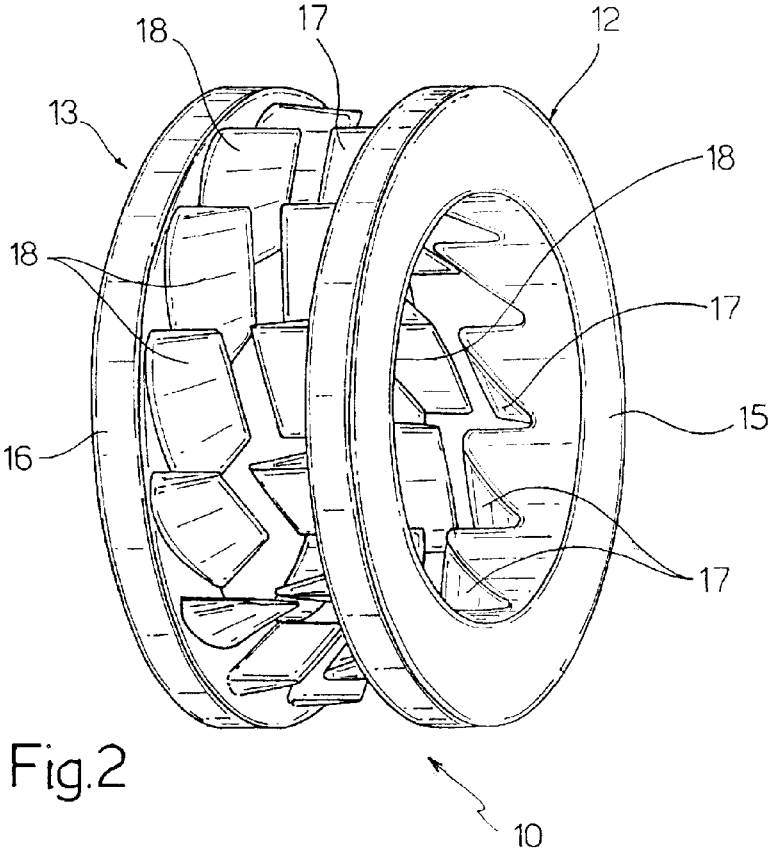
FIG. 2 is a perspective view of a nozzle of the turbine of FIG. 1.
Figure 3:
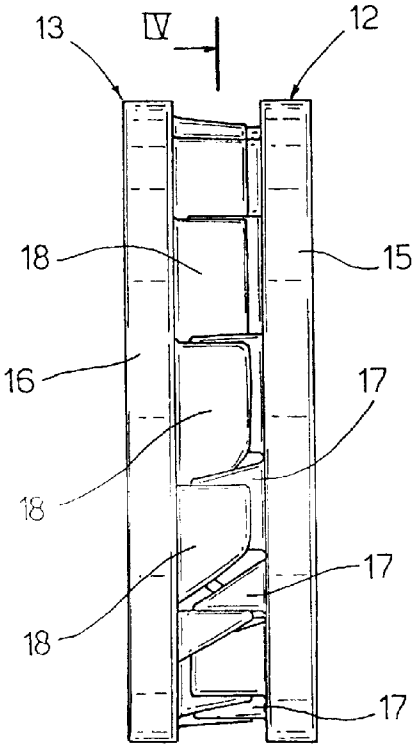
FIG. 3 is a lateral elevation of the nozzle of FIG. 2.

According to the present invention (FIGS. 2 and 3), the nozzle 10 is formed by a pair of annular vaned rings 12, 13 which face one another axially and axially bound the throat section 11 of the nozzle 10. More particularly, the two vaned rings 12, 13 comprise respective annular members 15, 16 and respective pluralities of vanes 17, 18 rigidly connected to the respective annular members 15, 16. The vanes 17, 18 of each vaned ring 12, 13 extend axially from the respective annular member 15, 16 towards the annular member 16, 15 of the other vaned ring 13, 12 and are tapered substantially as wedges such that the two pluralities of vanes 17, 18 can penetrate one another.

The vaned ring 12 is secured to the housing 3 of the turbine 1; the vaned ring 13 can move axially with respect to the ring 12 in order to vary the throat section 11 of the nozzle 10.

Preferably, the annular member 16 of the vaned ring 13 is disposed to slide in a leak-tight manner in an annular chamber 20 provided in the housing 3 (FIG. 1) and forms an annular piston of a pneumatic actuator 21 for the control of the throat section 11 of the nozzle 10. The axial position of the vaned ring 13 can therefore be directly controlled by varying the pressure in the chamber 20.

Figure 5:
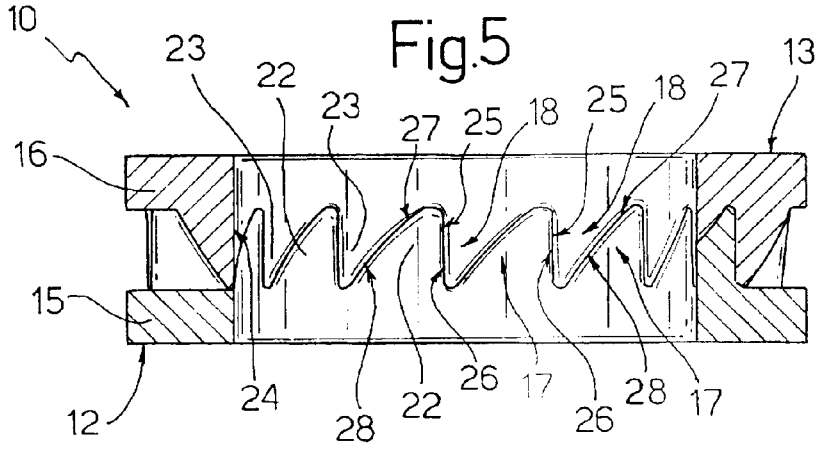
FIG. 5 is a section through the nozzle along the line V—V of FIG. 4 in a maximum closed configuration.
Figure 6:
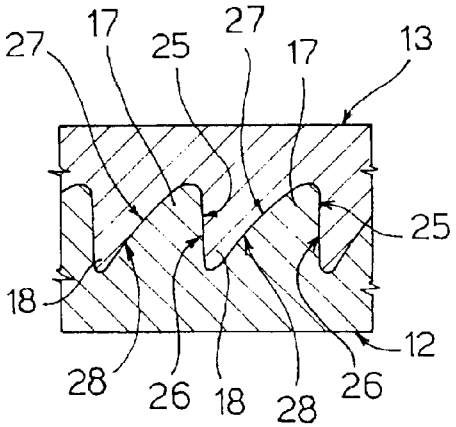
FIG. 6 is a partial section through the nozzle along the line VI—VI of FIG. 4.

With reference to FIGS. 5 and 6, the vanes 17, 18 are shaped so as to mesh with one another in a completely closed configuration of the nozzle 10, in which the vaned ring 13 is in the position of maximum axial advance and is disposed in contact with the vaned ring 12. The vanes 17, 18 are disposed in a substantially tangential direction on the respective annular members 15, 16 and have, in a section obtained using a cylinder of axis A, a triangular, and preferably saw-tooth, profile.

Figure 4:
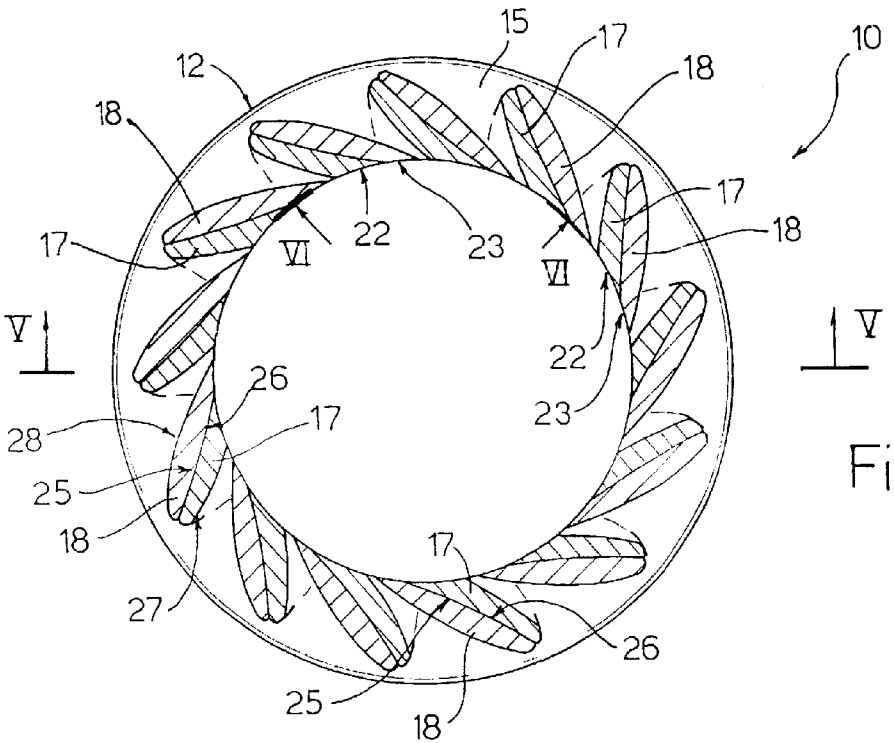
FIG. 4 is a section through the nozzle along the line IV—IV of FIG. 3.

FIG. 6 is a radial view of the vanes from inside the nozzle, i.e. an output section of the nozzle 10 obtained using a cylinder of axis A and a diameter equal to the inner diameter of the annular members 15, 16 (line VI—VI of FIG. 4).

In the embodiment shown (FIG. 5), the vanes 17, 18 are bounded in this output section by head surfaces 22, 23 which form, in the maximum closed configuration of the nozzle 10, a continuous cylindrical inner wall 24 of the nozzle 10 (FIG. 5), aligned with the inner surface of the annular members 15 and 16. It will be appreciated from FIGS. 5 and 6 that the vanes 17, 18 mesh perfectly with one another to define a zero throat section.

The vanes 17, 18 (FIGS. 4 to 6), also comprise respective substantially plane flanks 25, 26 lying in respective tangential planes parallel to the axis A, and respective opposite inclined flanks 27, 28. As a result of the dynamic action exerted by the exhaust gases on the vanes 18, the moving vaned ring 13 is subject to a torque such as to maintain the flanks 26 of the vanes 18 in contact with the flanks 25 of the vanes 17 of the fixed vaned ring 13, in any axial position of the vaned ring 13. The latter, therefore, may be housed in an angularly free manner in the housing 3, as its correct angular position is maintained by the mutual contact between the flanks 25, 26 of the vanes 17, 18. This solution is therefore particularly simple and economic.

It is not necessary for the flanks 25, 26 to be plane or axial, as it is sufficient for them to have a complementary shape and to mesh with one another in any configuration of the nozzle 10 so as to prevent the formation of leakages that could be detrimental to the efficiency of the turbine 1.

As an alternative, guide means (not shown) could be provided in order angularly to lock the vaned ring 13 so that it can only move axially; these means may be formed by any type of prismatic coupling, for instance a bar/bushing or cable/key.

When there are angular guide means, it is not necessary for there to be contact between the flanks 25, 26 of the vanes 17, 18 in any configuration of the nozzle 10. According to the variant shown in FIG. 7, the vanes 17, 18 have an asymmetrical triangular profile with both the flanks 25, 27 and 26, 28 inclined.

Figure 7:
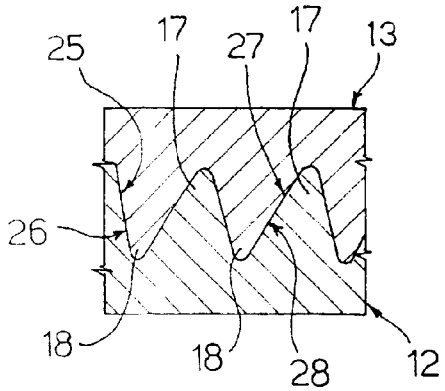
FIGS. 7, 8 and 9 are sections corresponding to that of FIG. 6 and show embodiments in which the geometry of the nozzle varies.

The profiles of the vanes 17 and 18 illustrated in FIGS. 6 and 7 are fully complementary, making it possible to obtain a leak-tight closed configuration of the nozzle 10.

Figure 8:
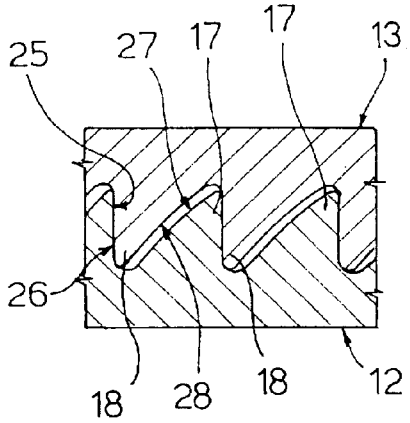
Figure 9:
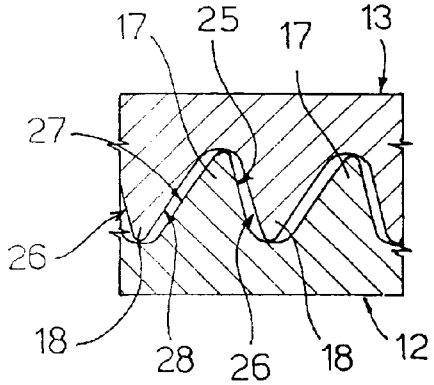

FIGS. 8 and 9 show further variants of the profile of the vanes 17, 18 in which these vanes do not mesh completely in the closed configuration of the nozzle 10 so as to leave free a minimal predetermined throat section 11 even in the maximum closed configuration of the nozzle 10, which may be preferable in some applications.

In the solution of FIG. 8, the profile is a saw-tooth profile in order angularly to guide the vaned ring 13 exclusively by means of contact between the flanks 25, 26 of the vanes 17, 18 as in the solution of FIG. 6. The flanks 27, 28 are not, however, in contact in the maximum closed position.

In the solution of FIG. 9, the profile of the vanes 17, 18 is triangular and asymmetrical, similarly to FIG. 7, and there are openings both between the flanks 25, 26 and between the flanks 27, 28 in the maximum closed position of the nozzle 10.

In operation, the operating fluid enters the nozzle 10 in a substantially radial direction from outside, i.e. from the inlet channel 6, and is deflected by the vanes 15, 16 according to their pitch angle to the rotor 4. By means of the axial displacement of the vaned ring 13, the throat area 11 of the nozzle 9 is chiefly controlled between the tapered flanks of the vanes 17, 18 and only marginally between the points of the vanes and the annular members 15, 16. The gases therefore drive the rotor 4 in rotation and escape axially through the outlet duct 8.

The throat section can be varied from a maximum to a minimum value in the maximum closed configuration of the nozzle 10 which, in the case of the variants shown in FIGS. 6 and 7, is zero. In operation, this condition causes the flow of operating fluid to stop and may be advantageously used, in an internal combustion engine/turbocompressor system, in the phases of braking with the engine brake, cold starting and emergency stopping of the engine.

The advantages that can be obtained with the present invention are evident from an examination of the characteristic features of the turbine 1.

The use of two vaned rings moving axially with respect to one another and having respective pluralities of vanes tapered as wedges makes it possible to avoid any problem of seizing of the nozzle and also eliminates the typical constraints as regards the design of vanes of known solutions.

If the two pluralities of vanes are produced with respective flanks of complementary shape in order to ensure contact between these flanks in any configuration of the nozzle, the moving vaned ring may be housed in an angularly free manner in the housing, thereby obtaining a particularly simple and economic solution.

What is claimed is:

1. A variable geometry turbine comprising a housing, a rotor supported in a rotary manner in the housing, the housing defining an inlet channel for an operating fluid in the form of a spiral surrounding the rotor, and an annular vaned nozzle of variable geometry interposed radially between the channel and the rotor in order to control the flow of the operating fluid from the channel to the rotor, characterised in that a first annular vaned ring and a second vaned ring face one another each of the vaned rings comprising an annular member and a plurality of vanes rigidly connected to the annular member and extending towards the annular member of the other vaned ring these vanes being axially tapered to substantially form wedges such that the two pluralities of vanes penetrate one another, at least one of the vaned rings being axially mobile with respect to the other vaned ring so as to define a variable throat section between the vaned rings.

2. A turbine as claimed in claim 1, characterised in that the pluralities of vanes substantially mesh with one another in a maximum closed configuration of the nozzle.

3. A turbine as claimed in claim 1, characterised in that the vanes are bounded, in a radially internal output section of the nozzle, by head surfaces forming an inner wall of the nozzle, this inner wall being continuous in the maximum closed configuration with the exception of passage openings formed between pairs of adjacent flanks of the vanes and defining a minimal residual throat section of the nozzle.

4. A turbine as claimed in claim 1, characterised in that the first vaned ring is secured to the housing and in that a the second vaned ring moves at least axially with respect to the first varied ring.

5. A turbine as claimed in claim 4, further comprising guide means in order to define a predetermined angular position of the second vaned ring with respect to the first vaned ring.

6. A variable geometry turbine comprising a housing, a rotor supported in a rotary manner in the housing, the housing defining an inlet channel for an operating fluid in the form of a spiral surrounding the rotor, and an annular vaned nozzle of variable geometry interposed radially between the channel and the rotor in order to control the flow of the operating fluid from the channel to the rotor, characterised in that a first annular vaned ring and a second vaned ring face one another, each of the vaned rings comprising an annular member and a plurality of vanes rigidly connected to the annular member and extending towards the annular member of the other vaned ring, these vanes being tapered to substantially form wedges such that the two pluralities of vanes penetrate one another, at least one of the vaned rings being axially mobile with respect to the other vaned ring so as to define a variable throat section between the vaned rings, wherein the pluralities of vanes substantially mesh with one another in a maximum closed configuration of the nozzle, and wherein the vanes are bounded, in a radially internal output section or the nozzle, by head surfaces forming a continuous inner wall of the nozzle in the maximum closed configuration.

7. A turbine as claimed in claim 6, characterised in that the inner wall of the nozzle is cylindrical and aligned with the inner surface of the annular members.

8. A variable geometry turbine comprising a housing, a rotor supported in a rotary manner in the housing, the housing defining an inlet channel for an operating fluid in the form of a spiral surrounding the rotor, and an annular varied nozzle of variable geometry interposed radially between the channel and the rotor in order to control the flow of the operating fluid from the channel to the rotor, characterised in that a first annular vaned ring and a second vaned ring face one another, each of the vaned rings comprising an annular member and a plurality of vanes rigidly connected to the annular member and extending towards the annular member of the other vaned ring, these vanes being tapered to substantially form wedges such that the two pluralities of vanes penetrate one another, at least one of the vaned rings being axially mobile with respect to the other vaned ring so as to define a variable throat section between the vaned rings, further comprising guide means in order to define a predetermined angular position of the second vaned ring with respect to the first vaned ring, wherein the first vaned ring is secured to the housing and the second vaned ring moves at least axially with respect to the first vaned ring, and wherein the second varied ring is angularly free with respect to the housing, the guide means being defined by respective first flanks of the vanes of the first vaned ring cooperating with respective second flanks of the vanes of the second vaned ring, this second vaned ring being maintained in the predetermined angular position, in which the first and second flanks are in mutual contact, by a torque resulting from the dynamic action exerted by the operating fluid on the vanes of the second vaned ring.

9. A turbine as claimed in claim 8, characterised in that the first and second flanks have a complementary shape.

10. A turbine as claimed in claim 9, characterised in that the first and second flanks are substantially planar.

11. A turbine as claimed in claim 8, characterised in that the first and second flanks lie in substantially tangential planes parallel to an axis of the turbine.

12. A turbine as claimed in claim 11, characterised in that the vanes have, in a section preformed with a cylinder coaxial to the turbine, a substantially triangular profile.

13. A turbine as claimed in claim 12, characterised in that the profile is a saw-tooth profile.

* * * * *

UNITED STATES PATENT AND TRADEMARK OFFICE

CERTIFICATE OF CORRECTION

PATENT NO. : 6,726,447 B2
DATED : April 27, 2004
INVENTOR(S) : Ernst Lutz

It is certified that error appears in the above-identified patent and that said Letters Patent is hereby corrected as shown below:

Column 4,
Line 65, “that a the” should read -- that the --.
Line 67, “varied” should read -- vaned --.

Column 5,
Line 35, “varied” should read -- vaned --.

Signed and Sealed this

Second Day of November, 2004

JON W. DUDAS
*Director of the United States Patent and Trademark Office*